US008197270B2

(12) United States Patent
Vasbinder et al.

(10) Patent No.: US 8,197,270 B2
(45) Date of Patent: Jun. 12, 2012

(54) ELECTRICAL CONNECTOR HAVING REVERSIBLE WIRE DRESS

(75) Inventors: Andrew Jacob Vasbinder, Etters, PA (US); John R Shuey, Mechanicsburg, PA (US); Keith Richard Foltz, Duncannon, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 311 days.

(21) Appl. No.: 12/456,794

(22) Filed: Jun. 23, 2009

(65) Prior Publication Data

US 2010/0323537 A1 Dec. 23, 2010

(51) Int. Cl.
*H01R 12/00* (2006.01)

(52) U.S. Cl. ..... 439/157

(58) Field of Classification Search ..... 439/157
See application file for complete search history.

(56) References Cited

U.S. PATENT DOCUMENTS

| | | | | |
|---|---|---|---|---|
| 5,489,224 | A * | 2/1996 | Schwarz | 439/752 |
| 5,928,012 | A * | 7/1999 | Kitamura | 439/157 |
| 6,254,407 | B1 | 7/2001 | Burns | |
| 6,682,361 | B2 | 1/2004 | Zweigle | |
| 6,702,597 | B2 | 3/2004 | Pade | |
| 6,960,090 | B2 | 11/2005 | Denter et al. | |
| 6,997,725 | B2 * | 2/2006 | Stella et al. | 439/157 |
| 7,695,296 | B1 * | 4/2010 | Hitchcock et al. | 439/157 |

* cited by examiner

*Primary Examiner* — Tulsidas C Patel
*Assistant Examiner* — Travis Chambers

(57) ABSTRACT

An electrical connector assembly is disclosed having a main housing portion, camming slide mounting in camming slide receiving guides of the main housing portion, a wire guide and a lever. The lever is operably coupled to the camming slides to translate the camming slides upon rotation of the lever. The lever is mounted to the wire guide, and the combination of the wire guide and the lever are reversible to reverse the orientation of the wires in the wire dress.

20 Claims, 9 Drawing Sheets

ELECTRICAL CONNECTOR HAVING REVERSIBLE WIRE DRESS

FIELD OF THE INVENTION

The subject disclosure relates generally to an electrical connector assembly having an actuation system to effect mating engagement of two connector halves.

BACKGROUND OF THE INVENTION

Connector arrangements may have a plug housing, a socket housing, and an actuation means for moving one of the housings into engagement with the other housing such that receptacle contacts of the socket housing are electrically connected to pluggable contacts of the plug housing. These types of plug connector arrangements are primarily used in applications having high pin counts and low engagement force is needed.

In order to save space, the moveable housing is formed so that only a small portion of the moveable housing projects from the fixed housing when the housings are engaged. This configuration causes the disengagement of the moveable housing from the fixed housing to be difficult. A problem also exists in that the plug connector arrangement has a large number of contact elements that exert a high normal contact force such that considerable force is required to plug-in and release the moveable housing from the fixed housing.

In order to resolve these problems, plug connector arrangements have been provided with actuation systems including camming slides. The actuation slides are arranged on the movable housing and are displaceable in a direction transverse to a direction of engagement. For example, the camming slides may be provided with camming slots that engage with cam projections on the fixed housing. Movement of the movable housing toward the fixed housing can be performed by displacement of the actuation slides transversely with respect to the direction of the movement of the moveable housing toward the fixed housing. In another example, an actuation slide means may be constructed as a toothed rack wherein the displacement of the moveable housing is forced by rotary movement of a pivotal lever with a pinion region engaging in the toothed rack. Examples of such actuation slides are taught by European Patent No. 0 273 999 B1 and U.S. Pat. Nos. 5,478,251; 5,593,309; 5,618,194 and 5,660,556. The actuation slide may be able to move through a lever as shown in U.S. Pat. No. 6,960,090.

Normally, these connector assemblies have a wire guide having the lever mounted to it, and the lever, in the fully mated position, is locked to the wire guide. Often times, the location of the fixed housing requires that the wire guide dresses the wires in alternate orientations, requiring two connector assemblies.

It is therefore desirable to develop a plug connector arrangement which can be utilized in alternate wire guide orientations, without the requirement for substitution of additional components parts.

SUMMARY OF THE INVENTION

The objects have been accomplished by providing an electrical connector assembly, comprising a main housing portion having a front face, a rear face, and sidewalls therebetween, the sidewalls having camming slide receiving guides. Camming slides are received in the camming slide receiving guides, where the camming slides having first actuation members adjacent the front face, and second actuation members adjacent the rear face. A lever is rotatably mounted relative to the main housing portion and has third actuation members in operative coupling with the second actuation members to translate the slides upon rotation of the lever. The lateral centerline of the center of rotation of the lever and the lateral centerline of the main housing portion are coincident.

In another embodiment, an electrical connector assembly, comprising a main housing portion having a front face, a rear face, and sidewalls therebetween, where the sidewalls have camming slide receiving guides. Camming slides are received in the camming slide receiving guides, and the camming slides having first actuation members adjacent the front face, and second actuation members adjacent the rear face. A wire guide is positioned adjacent to the rear face in a first configuration, having a laterally extending wire guiding member for dressing wires of a harness in a first lateral direction. A lever is rotatably mounted to the wire guide and has third actuation members in operative coupling with the second actuation members to translate the slides upon rotation of the lever. The wire guide is reversely mountable to the main housing portion in a second direction, for dressing wires of a harness in a second lateral direction.

In yet another embodiment, an electrical connector assembly, comprises a main housing portion having a front face, a rear face, and first and second sidewalls therebetween, where the sidewalls have first and second camming slide receiving guides positioned adjacent to respective first and second sidewalls. Camming slides are received in the camming slide receiving guides, and the camming slides having first actuation members adjacent the front face, and second actuation members adjacent the rear face. An actuator having third actuation members is cooperable with the second actuation members to translate the camming slides. A first camming slide is operable in the first camming slide receiving guide in a first sense, and is operable in the second camming slide receiving guide in a second sense. The second camming slide is operable in the second camming slide receiving guide in a first sense, and is operable in the first camming slide receiving guide in a second sense.

DETAILED DESCRIPTION OF THE EMBODIMENTS

Figure 1:
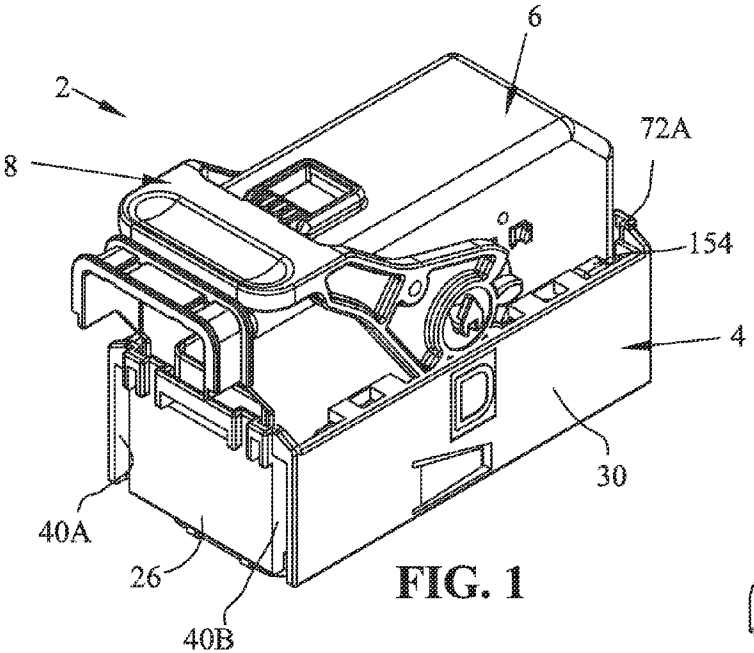
FIG. 1 is a top perspective view of the electrical connector assembly.
Figure 2:
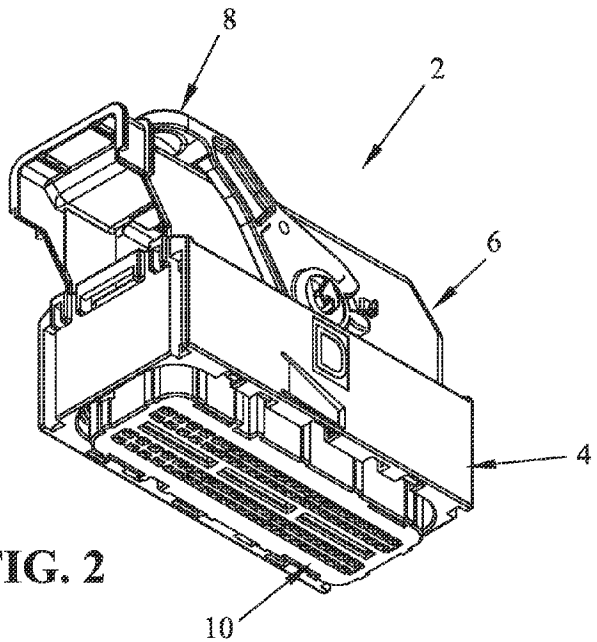
FIG. 2 is a bottom perspective view of the electrical connector assembly of FIG. 1.
Figure 3:
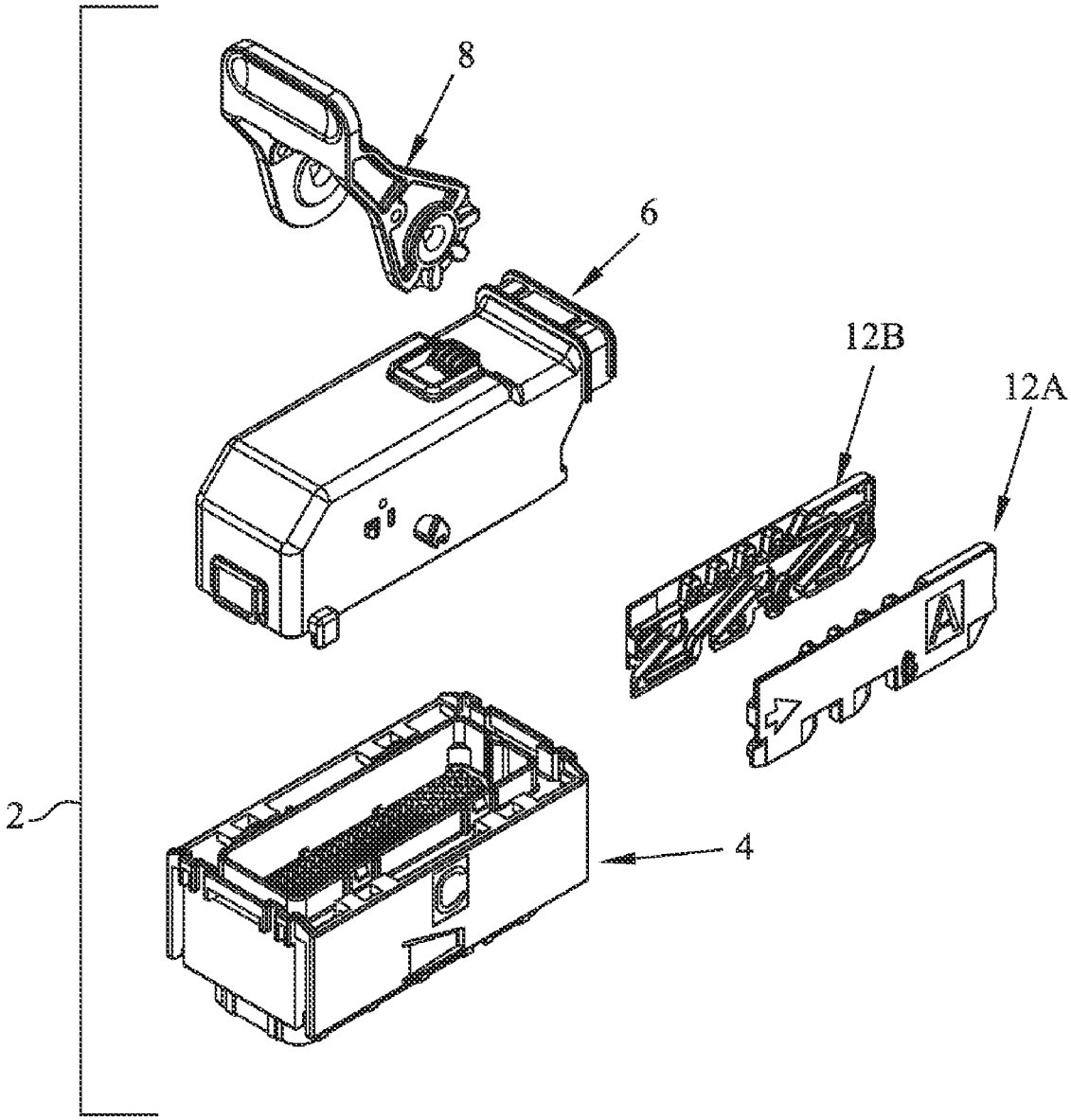
FIG. 3 is an exploded view of the electrical connector assembly of FIGS. 1 and 2.

With reference first to FIGS. 1 and 2, electrical connector assembly 2 is shown as comprised of main housing portion 4, wire guide 6, lever 8 pivotally mounted to wire guide 6, and a terminal position assurance member (TPA) 10 (FIG. 2). With reference now to FIG. 3, in addition to the components described above, electrical connector assembly 2 further comprises camming slides 12A, 12B, which are receivable in the main housing portion 4 and which will cooperate with lever 8 to provide for mating/unmating with a cooperable connector (not shown).

Figure 6:
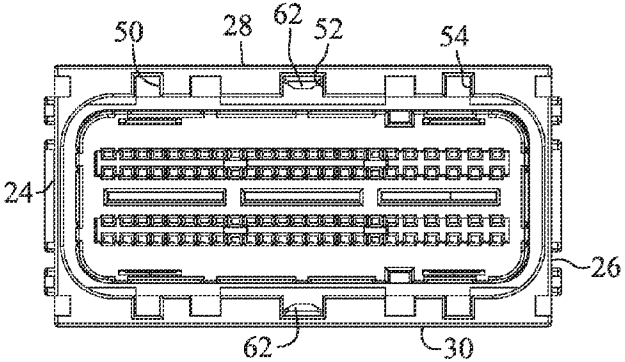
FIG. 6 is a bottom plan view of the main housing portion.
Figure 5:
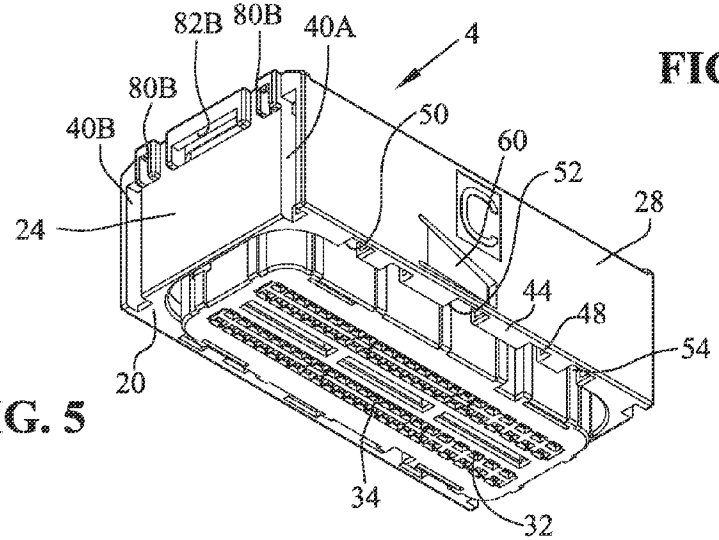
FIG. 5 is a bottom perspective view of the main housing portion.
Figure 4:
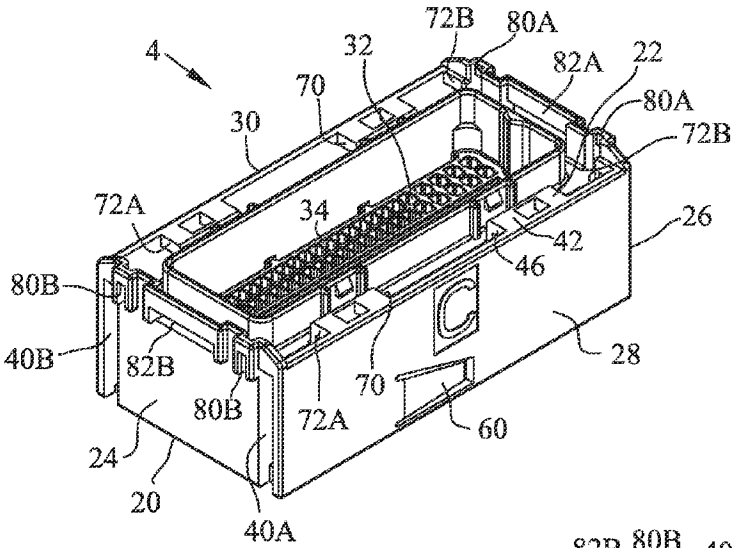
FIG. 4 is a top perspective view of the main housing portion.
Figure 7:
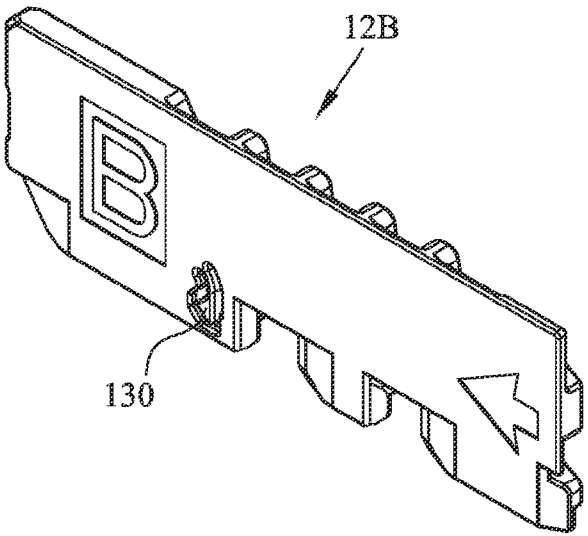
FIG. 7 is a top perspective view of one of the camming slides.
Figure 8:
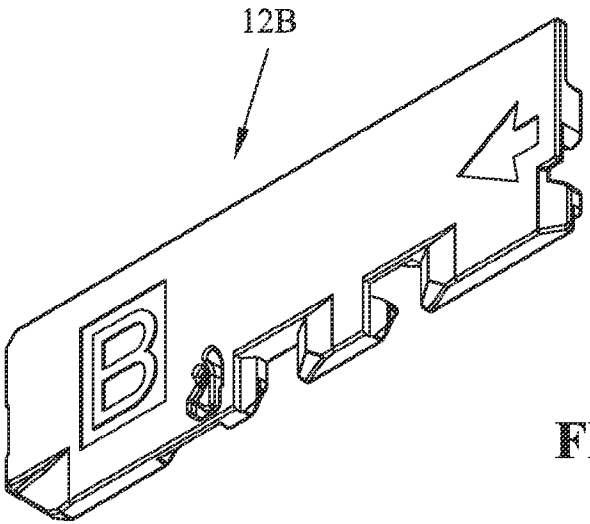
FIG. 8 is a bottom perspective view of the camming slide of FIG. 7.

With reference now to FIGS. 4-6, main housing portion 4 will be described in greater detail. Main housing portion 4 includes front face 20, rear face 22, end walls 24 and 26 and first and second sidewalls 28 and 30, respectively. As best shown in FIG. 4, main housing portion 4 includes a plurality of terminal receiving passageways, for example, at 32 and 34 for receipt of a plurality of terminals (not shown) as is known in the art. Passageways 32 and 34 extend through to the front face 20 (through TPA 10) as best shown in FIG. 5.

With respect now to FIGS. 4, 5 and 1, sidewall 28 may be labeled with an indicia, for example, sidewall 28 is labeled with the letter "C" (FIG. 4) whereas sidewall 30 is labeled with indicia "D" (FIG. 1), which may be useful with the assembly of the connector assembly as is described herein. Main housing portion 4 includes a first camming slide receiving guide 40A which is adjacent to sidewall 28. Camming slide receiving guide 40A defines a slot extending behind sidewall 28 and is formed by L-shaped walls such as 42 (FIG. 4) and 44 (FIG. 5) which define slots 46 (FIG. 4) and 48 (FIG. 5) therein. A second camming slide receiving guide 40B has similarly defined L-shaped walls and slots and is positioned adjacent to sidewall 30 as shown in FIGS. 1 and 4. As should be appreciate from comparing FIGS. 1 and 4, camming slide receiving guides 40A and 40B extend entirely through main housing portion 4, that is, between and through end walls 24, 26. As best shown in FIGS. 5 and 6, L-shaped walls 44 define openings 50, 52 and 54, which receive the lugs on the mating connector (not shown) as is known in the art.

As shown in FIGS. 4-6, sidewall 28 includes a latch arm 60 having a latching lug 62 (FIG. 6) aligned with opening 52, the purpose of which will be described herein. With respect again to FIG. 4, rear face 22 is provided with access openings 70 for the lever as described herein. Openings 72A and 72B are provided for polarization of the wire guide 6 as described herein. Finally, with respect to FIGS. 4 and 5, the end wall 26 includes hook receiving catches 80A while end wall 24 includes hook receiving catches 80B. End wall 26 also includes latch 82A, while end wall 24 includes latch 82B.

With respect now to FIGS. 7-10, first and second camming slides 12A and 12B will be described. It should be understood that the camming slide 12A, 12B are simply mirror images of each other, and therefore only camming 12A will be described herein.

Figure 11:
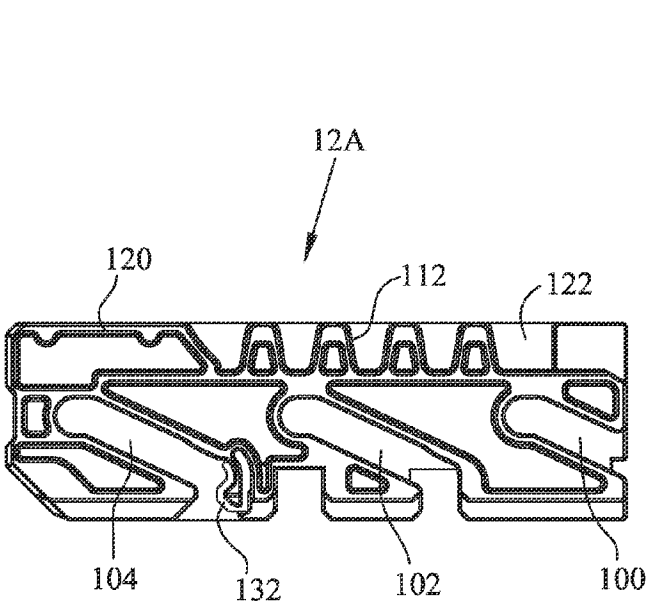
FIG. 11 is a side view of the camming slide of FIGS. 9 and 10.
Figure 9:
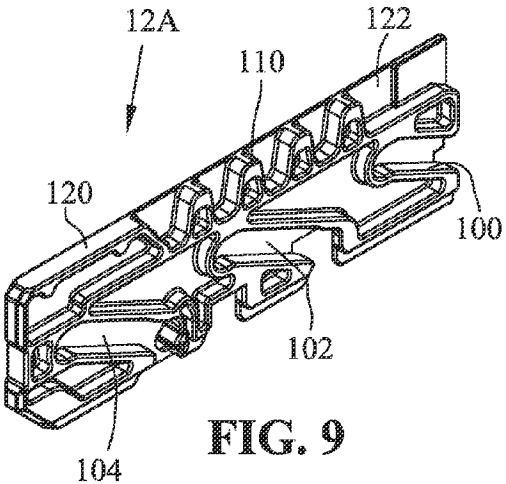
FIG. 9 is an top perspective view showing the inside of the other of the camming slides.
Figure 10:
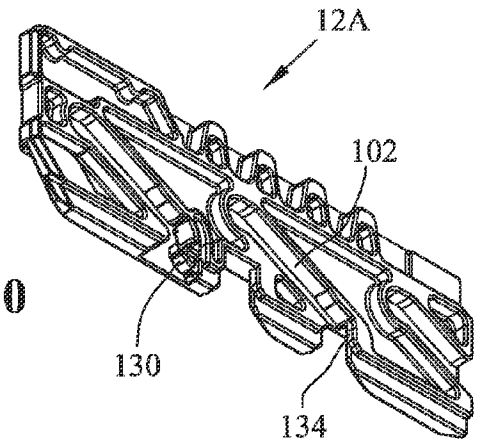
FIG. 10 is a bottom perspective view of the camming slide of FIG. 9.

As shown best in FIG. 9, camming slide 12A includes actuation members in the form of camming slots 100, 102 and 104 which will be positioned approximate to openings 50, 52, 54 as described herein. Camming slide 12A also includes actuation members 110 in the form of individual rack teeth 112. Slide 12A also includes a positioning feature to insure that the camming slide is positioned in the proper orientation relative to the wire guide and includes an upper stop surface 120 and an upper open surface 122, as described herein. A resilient latch arm 130 (FIG. 7) is defined in the camming slide having a latching lug at 132 (FIG. 11) which is positioned at the mouth of camming slot 104. Finally, a locking shoulder 134 (FIG. 10) is positioned adjacent to camming slot 102 and cooperates with latching lug 62 (FIG. 6) as described herein. Camming slides 12A and 12B may be marked with indicia, for example camming slide 12B is labeled "B" (FIG. 7), whereas camming slide 12A is labeled "A" (FIG. 1).

Figure 14:
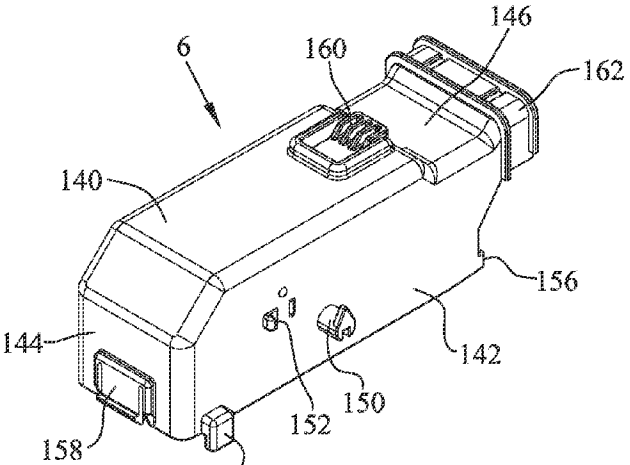
FIG. 14 is an top perspective view of the wire guide of FIGS. 12 and 13 taken from an opposite direction.
Figure 12:
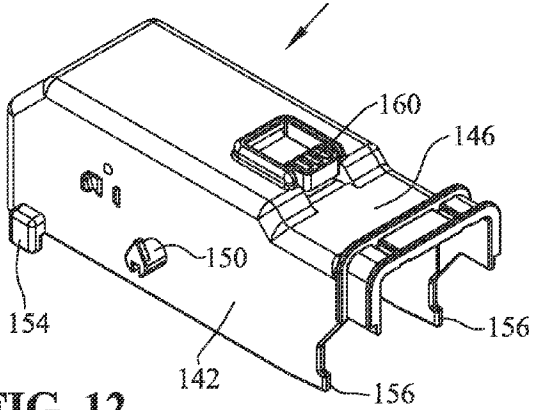
FIG. 12 is an top perspective view of the wire guide.
Figure 13:
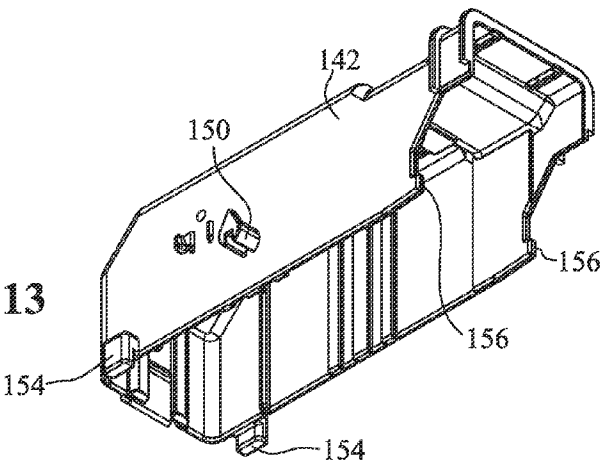
FIG. 13 is a bottom perspective view of the wire guide of FIG. 12.

With reference now to FIGS. 12-14, wire guide 6 will be described in greater detail. As shown, wire guide 6 includes top wall 140, sidewalls 142, end wall 144 and neck 146. Sidewalls 142 include a stub shaft 150 for receipt of lever 8 as described herein. Sidewalls 142 also include a stop surface 152, stop lugs 154, and hooks 156. End wall 144 includes latch 158 and top wall 140 includes latch 160. It should be appreciated that neck 146 includes a receiving portion 162 which is profiled to receive a plastic tie, which will wrap around a plurality of wires which exit the wire guide through the neck 146.

Figure 15:
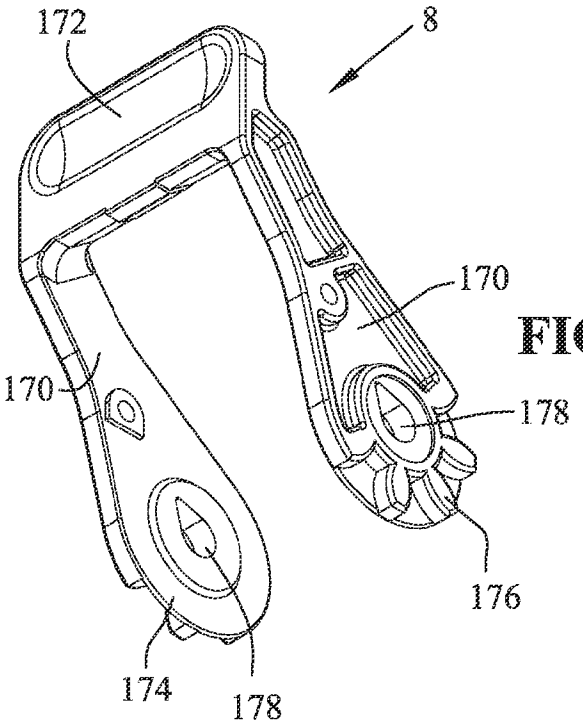
FIGS. 15 and 16 show opposite perspective views of the lever.
Figure 16:
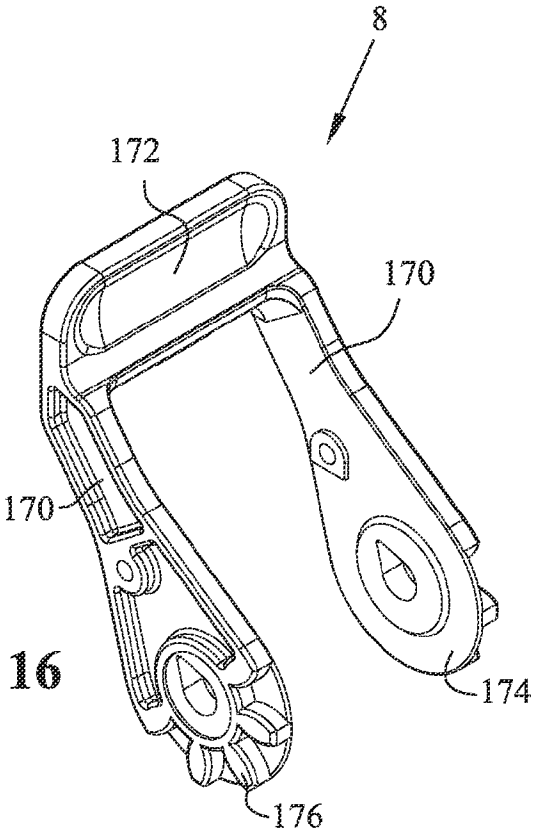
Figure 17:
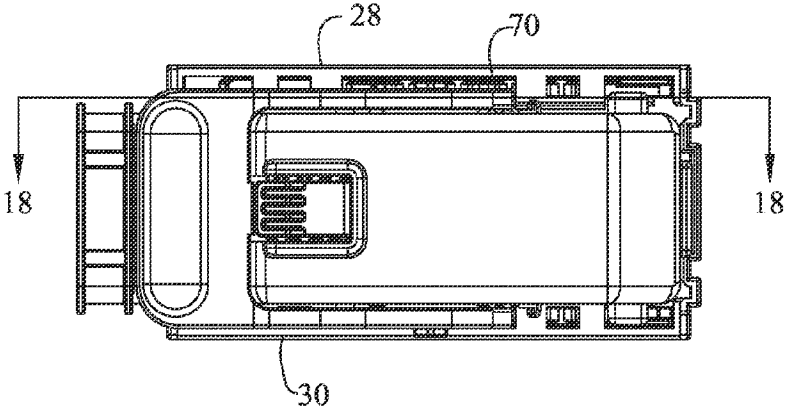
FIG. 17 shows a top plan view of the electrical connector assembly in a locked condition with the wire guide in a first configuration.

With reference now to FIGS. 15 and 16, lever 8 is shown as including lever arms 170 connected by way of handle 172. Each arm end includes a rotary portion 174 including pinion teeth 176. A teardrop-shaped opening 178 is positioned at a central location of the rotary portion of 174 to be received over stub shaft 150 as described herein.

Figure 20:
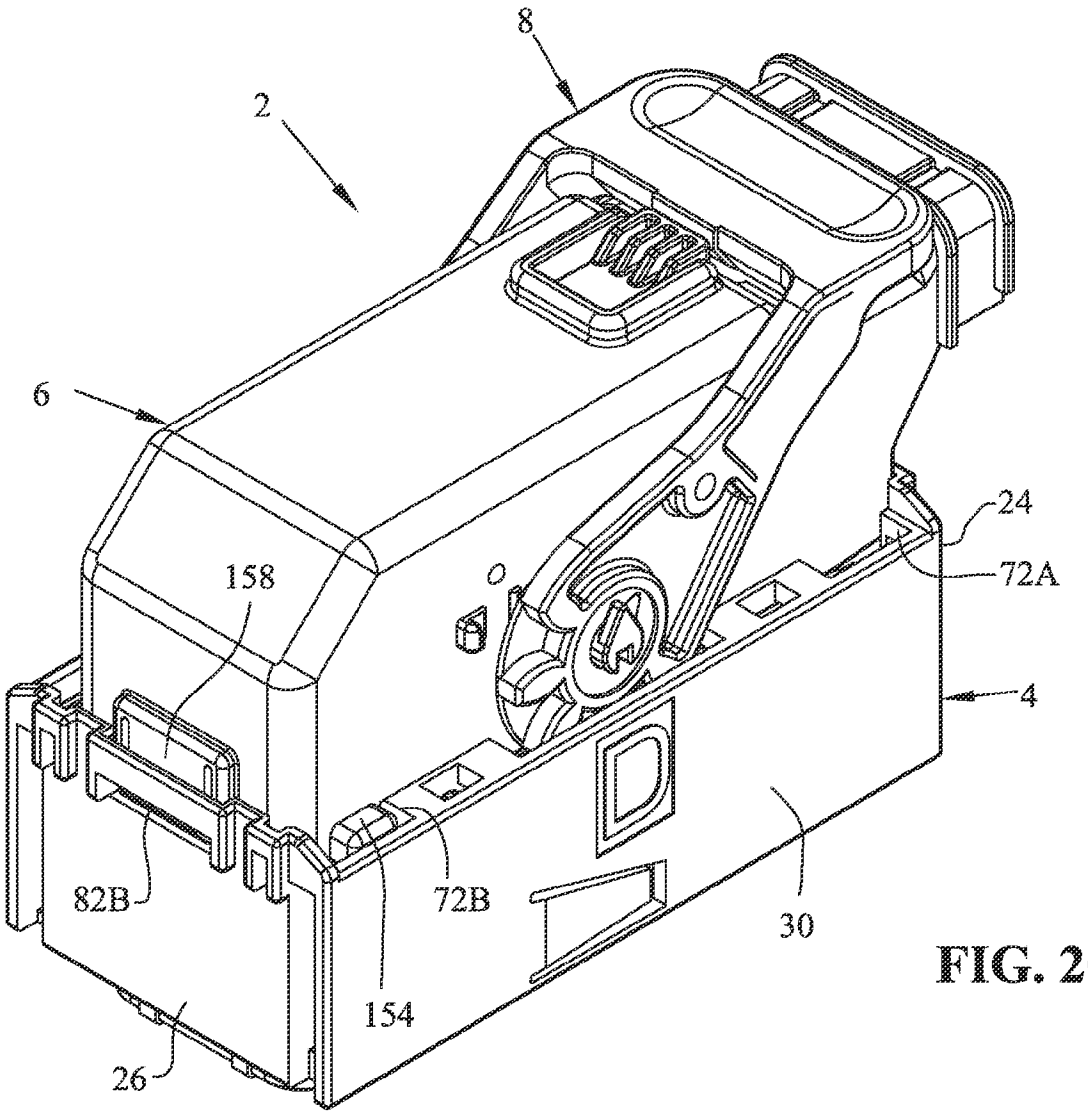
FIG. 20 shows the connector assembly as assembled in the second configuration.

It should be understood that the features as described above allow for the combination of the wire guide 6 and lever 8 to be positioned in one of two configurations, where the first configuration is shown in FIG. 1, where wires would be dressed in the first lateral direction over end wall 26, and a second configuration where wires would be dressed in the second lateral direction over end wall 24 (FIG. 20). Wire guide 6 is now positioned and held to main housing portion 4 in the first and second configurations by way of retaining assemblies comprised of the hooks 156 (FIG. 12) and hook receiving catches 80A, 80B (FIG. 4); and latches 158 (FIG. 14) and corresponding latches 82A, 82B (FIG. 4).

To assemble the connector assembly into the first configuration, camming slides 12A and 12B are positioned in their respective camming slide receiving guides 40A, 40B until such time as camming slots 100, 102 and 104 (FIG. 11) align with corresponding openings 50, 52, 54 (FIG. 5). In such a position, locking shoulder 134 (FIG. 10) locks with latching lug 62 (FIG. 6) preventing the camming slides 12A and 12B from moving any further inward yet retaining the camming slots 100, 102 and 104 aligned with the respective openings 50, 52, 54. Also when in such a position, the camming slides 12A, 12B have the actuation members in the form of camming slots 100, 102 and 104 adjacent the front face 20, and actuation members 110 adjacent the rear face 22.

Lever 8 may now be positioned over stub shaft 150 and moved to the fully open position, that is, against stop surfaces 152 (FIG. 14). As is known in the art, a plurality of wires of a harness are then terminated to individual contacts and inserted through cavities 32, 34. TPA 10 is then snapped into the fully locked position assuring that the terminals are loaded into their fully locked position. Hooks 156 are inserted into first hook receiving catches 80A (FIG. 4) and then wire guide 6 is rotated until latch 158 (FIG. 14) snaps beneath latch 82*a* (FIG. 4). It should be appreciated that pinion teeth 176 fit through access opening 70 (FIG. 20) and mesh with, and are operatively coupled with, rack teeth 112 and that, in normal operation, rotation of lever 8 will cause translation of camming slides 12A, 12B within respective slots 40A, 40B. It should be understood however, that while camming slide 12A is locked by way of locking shoulder 134 and lug 62, that the lever 8 is also locked from pivoting.

Figure 19:
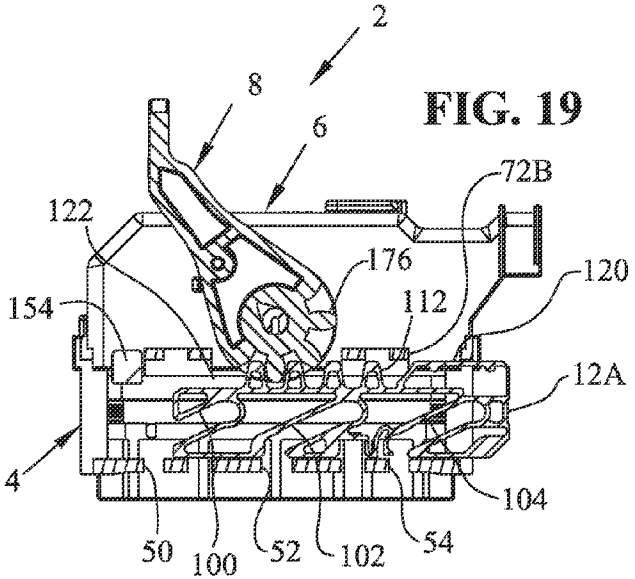
FIG. 19 shows a cross-sectional view similar to that of FIG. 18 showing a lever in the fully opened position.
Figure 18:
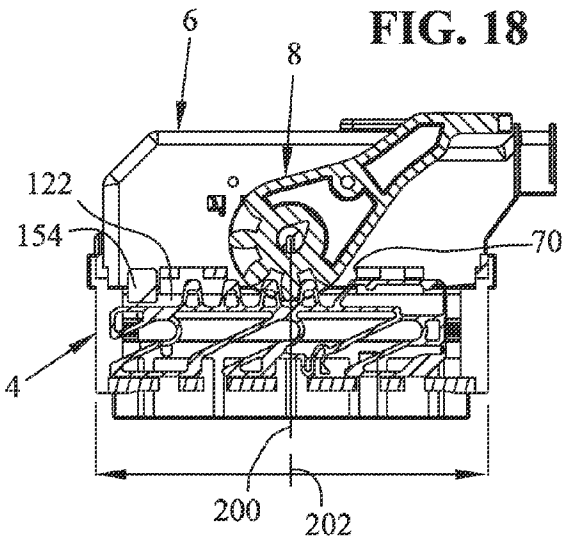
FIG. 18 shows a cross-sectional view through lines 18-18 of FIG. 17.

When wire guide 6 is positioned in main housing portion 4 such that stop lugs 154 (FIG. 12) are positioned in openings 72A (FIG. 4); stop lugs 154 are also shown within openings 72A in the assembled view in FIG. 1. As shown in FIG. 19, upper stop surface 120 on camming slide 12A is positioned such that it blocks opening 72B (FIG. 4), such that if a wire guide 6 were attempted to be placed in an opposite and incorrect direction, stop lugs 154 would engage stop surfaces 120 and would prevent such assembly.

When the mating connector (not shown) is positioned with the lugs in corresponding openings of the camming slots 100, 102 and 104, a lug in slot 102 releases the latch lug 62 (FIG. 6) and resultantly releases the camming slide for translation. At this time, the lever 8 is also released for pivotal movement, and the lever may be pivoted to draw the connector assemblies into a fully mated position. In the fully mated position; the handle 172 is snap latched into latch 160 of the wire guide 6, as shown in FIG. 1.

If it is desired to have the wire guide 6 exiting in the opposite sense, that is, as shown in FIG. 20, with the wires dressed in the direction over end wall 24, then the camming slides 12A and 12B are interchangeable within alternate camming guide receiving guides such that camming slide 12A is positioned in camming slide receiving guide 40B and camming slide 12B is positioned in camming slide receiving guide 40A. Hooks 156 of wire guide 6 are then positioned in hook receiving catches 80B (FIG. 4) and latch 158 (FIG. 14) latches with latch 82B (FIGS. 4 and 20). In this position, stop lugs 154 are positioned in openings 72B while stop surface 120 (FIG. 19) covers opening 72A.

Thus as described above, an electrical connector assembly is shown which allows two configurations for the wire guide and orientation security to prevent incorrect assembly. As the lateral centerline 200 of the center of rotation of the lever 8 is coincident with the lateral centerline 202 of the main housing portion 4, the wire guide 6 is reversibly mountable to the main housing portion 4, and therefore flipping the wire guide 6 into the first and second configuration maintains the alignment of all the working components. For ease of assembly the camming slides and sidewalls are marked with indicia, such that in a first configuration, the "A" camming slide is positioned adjacent to the "C" sidewall, and the "B" camming slide is positioned adjacent to the "D" sidewall; whereas in the second configuration the "A" camming slide is positioned adjacent to the "D" sidewall, and the "B" camming slide is positioned adjacent to the "C" sidewall.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

What is claimed is:

1. An electrical connector assembly, comprising:

a main housing portion having a front face, a rear face, and sidewalls therebetween, and camming slide receiving guides positioned adjacent to the sidewalls;

camming slides received in the camming slide receiving guides, the camming slides having first actuation members adjacent the front face, and second actuation members adjacent the rear face; and a lever rotatably mounted relative to the main housing portion and having third actuation members in operative coupling with the second actuation members to translate the camming slides upon rotation of the lever;

the lateral centerline of the center of rotation of the lever and the lateral centerline of the main housing portion being coincident, and the lever is reversely mountable relative to the main housing portion and operable in two rotational configurations.

2. The electrical connector assembly of claim 1, further comprising a wire guide positioned adjacent to the rear face in a first configuration, having a laterally extending wire guiding member for dressing wires of a harness in a first lateral direction.

3. The electrical connector assembly of claim 2, wherein the lever is mounted to the wire guide and the wire guide is reversely mountable to the main housing portion in a second configuration, for dressing wires of a harness in a second lateral direction.

4. The electrical connector assembly of claim 3, wherein the camming slides are interchangeable to operate in alternate camming slide receiving guides.

5. The connector assembly of claim 4, wherein the main housing portion comprises:

a first and second sidewall, with first and second camming slide receiving guides positioned adjacent to respective first and second sidewalls;

a first camming slide being operable in the first camming slide receiving guide in a first orientation, and being operable in the second camming slide receiving guide in a second orientation; and a second camming slide being operable in the second camming slide receiving guide in a first orientation, and being operable in the first camming slide receiving guide in a second orientation.

6. The connector assembly of claim 3, wherein the main housing portion and the wire guide have retaining assemblies cooperatively provided therebetween to retain the wire guide to the main housing portion in either the first or second configuration.

7. The connector assembly of claim 6, wherein the wire guide is provided with hooks at one end thereof and a latch at a second end, and the main housing portion comprises hook receiving catches at first and second ends, and a matable latch at first and second ends; the hooks being cooperable with the hook receiving catches at either end thereof, and the matable latch at the first and second ends are cooperable with the wire guide latch to orient the wire guide in the first or second configuration.

8. An electrical connector assembly, comprising:

a main housing portion having a front face, a rear face, and sidewalls therebetween, the sidewalls having camming slide receiving guides;

camming slides received in the camming slide receiving guides, the camming slides having first actuation members adjacent the front face, and second actuation members adjacent the rear face;

a wire guide positioned adjacent to the rear face in a first configuration, having a laterally extending wire guiding member for dressing wires of a harness in a first lateral direction;

a lever rotatably mounted to the wire guide and having third actuation members in operative coupling with the second actuation members to translate the slides upon rotation of the lever, the wire guide being reversely mountable to the main housing portion in a second direction, for dressing wires of a harness in a second lateral direction.

9. The connector assembly of claim 8, wherein the main housing portion comprises:

a first and second sidewall, with first and second camming slide receiving guides positioned adjacent to respective first and second sidewalls;

a first camming slide being operable in the first camming slide receiving guide in a first orientation, and being operable in the second camming slide receiving guide in a second orientation; and a second camming slide being operable in the second camming slide receiving guide in a orientation sense, and being operable in the first camming slide receiving guide in a second orientation.

10. The connector assembly of claim 9, wherein the wire guide and the camming slides cooperate to prevent incorrect assembly of the wire guide.

11. The connector assembly of claim 10, wherein the camming slides comprise an upper stop surface adjacent the rear face, and the wire guide comprises lugs, wherein the lugs contact the upper stop surfaces if the wire guide is incorrectly assembly.

12. The connector assembly of claim 9, wherein the main housing portion and the wire guide have retaining assemblies cooperatively provided therebetween to retain the wire guide to the main housing portion in either the first or second configuration.

13. The connector assembly of claim 12, wherein the wire guide is provided with hooks at one end thereof and a latch at a second end, and the main housing portion comprises hook receiving catches at first and second ends, and a matable latch at first and second ends; the hooks being cooperable with the hook receiving catches at either end thereof, and the matable latch at the first and second ends are cooperable with the wire guide latch to orient the wire guide in the first or second configuration.

14. An electrical connector assembly, comprising:

a main housing portion having a front face, a rear face, and first and second sidewalls therebetween, the sidewalls having first and second camming slide receiving guides positioned adjacent to respective first and second sidewalls;

camming slides received in the camming slide receiving guides, the camming slides having first actuation members adjacent the front face, and second actuation members adjacent the rear face;

an actuator having third actuation members cooperable with the second actuation members to translate the camming slides;

a first camming slide being operable in the first camming slide receiving guide in a first orientation, and being operable in the second camming slide receiving guide in a second orientation; and the second camming slide being operable in the second camming slide receiving guide in a first orientation, and being operable in the first camming slide receiving guide in a second orientation.

15. The electrical connector assembly of claim 14, wherein the actuator is a lever rotatably mounted relative to the main housing portion.

16. The electrical connector assembly of claim 15, wherein the lateral centerline of the center of rotation of the lever and the lateral centerline of the main housing portion being coincident.

17. The electrical connector assembly of claim 16, further comprising a wire guide positioned adjacent to the rear face in a first configuration, having a laterally extending wire guiding member for dressing wires of a harness in a first lateral direction.

18. The electrical connector assembly of claim 17, wherein the lever is mounted to the wire guide and the wire guide is reverse mountable to the main housing portion in a second direction, for dressing wires of a harness in a second lateral direction.

19. The connector assembly of claim 17, wherein the main housing portion and the wire guide have retaining assemblies cooperatively provided therebetween to retain the wire guide to the main housing portion in either the first or second configuration.

20. The connector assembly of claim 19, wherein the wire guide is provided with hooks at one end thereof and a latch at a second end, and the main housing portion comprises hook receiving catches at first and second ends, and a matable latch at first and second ends; the hooks being cooperable with the hook receiving catches at either end thereof, and the matable latch at the first and second ends are cooperable with the wire guide latch to orient the wire guide in the first or second configuration.

* * * * *